US011077014B2

(12) United States Patent
Rossi

(10) Patent No.: US 11,077,014 B2
(45) Date of Patent: Aug. 3, 2021

(54) SEX TOY

(71) Applicant: DARE PATENT PTY LTD., Victoria (AU)

(72) Inventor: Bruno Rossi, Victoria (AU)

(73) Assignee: DARE PATENT PTY LTD., Victoria (AU)

( * ) Notice: Subject to any disclaimer, the term of this patent is extended or adjusted under 35 U.S.C. 154(b) by 487 days.

(21) Appl. No.: 15/508,630

(22) PCT Filed: Sep. 4, 2015

(86) PCT No.: PCT/AU2015/000543

§ 371 (c)(1),
(2) Date: Mar. 3, 2017

(87) PCT Pub. No.: WO2016/033640

PCT Pub. Date: Mar. 10, 2016

(65) Prior Publication Data

US 2017/0239134 A1 Aug. 24, 2017

(30) Foreign Application Priority Data

Sep. 4, 2014 (AU) ..... 2014903529

(51) Int. Cl.
*A61H 19/00* (2006.01)
*A61H 23/02* (2006.01)

(52) U.S. Cl.
CPC ..... *A61H 19/44* (2013.01); *A61H 23/02* (2013.01); *A61H 2201/013* (2013.01); *A61H 2201/0157* (2013.01); *A61H 2201/149* (2013.01); *A61H 2201/1472* (2013.01); *A61H 2201/1664* (2013.01); *A61H 2201/1685* (2013.01); *A61H 2201/5035* (2013.01); *A61H 2201/5064* (2013.01); *A61H 2201/5097* (2013.01)

(58) Field of Classification Search
CPC ..... A61H 19/00–50; A61H 23/02; A61H 2201/149; A61H 2201/1472; A61H 2201/1664; A61H 2201/1685; A61H 2201/5064
See application file for complete search history.

(56) References Cited

U.S. PATENT DOCUMENTS

| | | | | |
|---|---|---|---|---|
| 7,513,868 B1 * | 4/2009 | Fontenot | ..... | A61H 19/44 600/38 |
| 2005/0273024 A1 * | 12/2005 | Nan | ..... | A61H 19/44 601/71 |
| 2009/0099413 A1 * | 4/2009 | Kobashikawa | ..... | A61H 19/34 600/38 |

FOREIGN PATENT DOCUMENTS

| | | | | |
|---|---|---|---|---|
| WO | 2003099189 A1 | 12/2003 | | |
| WO | WO-03099189 A1 * | 12/2003 | ..... | A61H 19/44 |
| WO | 2014043263 A1 | 3/2014 | | |

* cited by examiner

*Primary Examiner* — Catherine B Kuhlman
(74) *Attorney, Agent, or Firm* — Tarolli, Sundheim, Covell & Tummino LLP

(57) ABSTRACT

A sex toy comprising a body housing a motor; a shaft coupled to the motor; a massaging member mounted over the shaft; and a controller coupled to control the motor to drive the massaging member in a reciprocating motion along the length of the shaft is described. The reciprocating motion results in a change in length of the sex toy. The change in length may comprise about 20 mms to about 100 mms; about 25 mm to about 90 mm; or about 30 mm to about 85 mm. One full stroke of the reciprocating motion may be performed in about 0.5 to about 2.0 about seconds; about 0.6 to about 1.5 seconds; or about 0.7 to about 1.0 seconds.

11 Claims, 12 Drawing Sheets

SEX TOY

FIELD OF THE INVENTION

The present invention relates to sex toys, adult toys or internal massagers, such as thrusting vibrators, and in particular, motorised sex toys, adult toys or internal massagers that perform a reciprocating motion.

BACKGROUND TO THE INVENTION

There are a large number of sex toys available on the market. Some sex toys include movement to provide increased stimulation to the user. For example, internal massagers may provide movements within the body and thrusting vibrators or dildos may perform a reciprocating motion to mimic thrusting of a penis.

Some devices, such as thrusting vibrators or dildos, in the prior art provide reciprocating movement of a bump beneath an outer material of the device to mimic the thrusting of a penis. One problem with such devices is that they do not provide a true or realistic thrusting sensation to the user of the device, because only the bump moves up and down.

Other thrusting vibrators or dildos provide reciprocating movement of the vibrator or dildo. However, this movement typically involves a single repetitive thrusting distance, and therefore is somewhat unrealistic and provides limited enjoyment to the user. Also, a large portion of the device is usually occupied by the motor and the power supply.

The movement of thrusting vibrators and dildos in the prior art is also typically inaccurate and the movement may stick or jam when under load.

The reference to any prior art in this specification is not, and should not be taken as, an acknowledgement or any form of suggestion that the prior art forms part of the common general knowledge.

OBJECT OF THE INVENTION

It is a preferred object of the embodiments of the present invention to provide an apparatus that addresses or at least ameliorates one or more of the aforementioned problems of the prior art and/or provides a useful commercial alternative.

SUMMARY OF THE INVENTION

Generally, embodiments of the present invention relate to sex toys, adult toys or internal massagers, such as thrusting vibrators, and in particular, motorised sex toys, adult toys or internal massagers that perform a reciprocating motion.

In one form, although it need not be the only or indeed the broadest form, the invention resides in a sex toy comprising:

- a body housing a motor;
- a shaft coupled to the motor;
- a massaging member mounted over the shaft; and
- a controller coupled to control the motor to drive the massaging member in a reciprocating motion along the length of the shaft.

Suitably, the reciprocating motion may result in a change in length of the sex toy. The change in length may comprise about 20 mms to about 100 mms; about 25 mm to about 90 mm; or about 30 mm to about 85 mm.

Suitably, one full stroke of the reciprocating motion is performed in about 0.5 to about 2.0 about seconds; about 0.6 to about 1.5 seconds; or about 0.7 to about 1.0 seconds.

Suitably, the massaging member may be driven to a plurality of predetermined extension positions. The plurality of predetermined extension positions may comprise a first extension position comprising a change in length of about 25 mm (1 inch); a second extension position comprising a change in length of about 51 mm (2 inches); and a third extension position comprising a change in length of about 76 mm (3 inches).

Suitably, the sex toy may further comprise one or more sensors coupled to the controller to determine the extension position along the shaft.

In one embodiment, the controller may reverse the direction of the motor at one or more of the plurality of predetermined extension positions to drive the massaging member in the reciprocating motion.

Suitably, the massaging member may be mounted to a traveller that is in engagement with the shaft.

Suitably, the traveller may be designed to interchangeably mount massaging members having different sizes and/or shapes and/or surface textures.

Suitably, the traveller may comprise a head that extends over a distal end of the shaft.

Suitably, a twist and click ring may be provided on the massaging member or the head for securing the massaging member and/or the head to the traveller.

Suitably, the motor may rotate the shaft to drive the traveller along the shaft.

Suitably, the shaft may be coupled to the motor via a gear box.

Suitably, the traveller may be in engagement with the shaft via a shoe that is slidably mounted in a groove of the shaft.

Suitably, the sex toy may further comprise a guide between the shaft and the traveller to maintain an angular position of the shoe relative to the shaft while permitting movement of the shoe along the shaft.

Suitably, the groove may be a helical groove.

Suitably, the groove may be a continuous groove formed of a left-hand helical groove and a right-hand helical groove connected to one another at either end.

Suitably, a pitch of the helical groove and/or a configuration of the gear box may achieve a maximum torque at the traveller for the motor.

Suitably, the shoe may have an arcuate edge facing the shaft.

Suitably, the shoe may comprise a shoe head slidably mounted in the groove. The shoe head may have a length that is greater than a width of the groove.

In one embodiment, the shoe head may comprise a length approximately equal to one half the circumference of the shaft.

Suitably, one or more sides of the shoe head may be rounded and/or tapered adjacent the sides of the groove.

In another embodiment, the guide may be comprised on a torque sleeve that covers at least part of the shaft.

In yet another embodiment, the sex toy may comprise one or more support rods extending along at least a part of a length of the shaft.

In yet another embodiment, the torque sleeve may comprise one or more fins which provide additional structural support and rigidity. The one or more fins be comprised on the outside of the torque sleeve. The one or more fins may be integrally formed with torque sleeve.

In another embodiment, the sex toy may further comprise a plastic sheath positioned intermediate the toque sleeve and the head to provide an additional covering layer.

Suitably, the sex toy may comprise a sensor on the body and/or a sensor on the traveller.

Suitably, the sex toy may further comprise a vibrator adjacent a distal end of the massaging member. The vibrator may be positioned on top of the head or partially extending from the head. The vibrator may be operational during the driving of the massaging member.

Suitably, the controller may comprise a plurality of selectable programs to control the extension and/or a vibration of the sex toy.

Suitably, the sex toy may further comprise a power supply within the body coupled to power the motor. The power supply may be charged via a USB (Universal Serial Bus) connection, induction or may make use of one or more replaceable batteries.

Suitably, the body may be coupled to, or forms part of an ergonomic handle.

The toy may further comprise a female vibration unit attached to or moulded into the body. The vibration unit may comprise an interchangeable vibrational head.

Suitably, the sex toy may further comprise a communications device coupled to the controller to enable wireless control of the sex toy and/or vibrational unit.

Suitably, the communications device may be a Wi-Fi; a Bluetooth device; an infra-red device and/or other type of wireless communication.

Further aspects and/or features of the present invention will become apparent from the following detailed description.

BRIEF DESCRIPTION OF THE DRAWINGS

In order that the invention may be readily understood and put into practical effect, reference will now be made to embodiments of the present invention with reference to the accompanying drawings, wherein like reference numbers refer to identical elements. The drawings are provided by way of example only, wherein.

Figure 1:
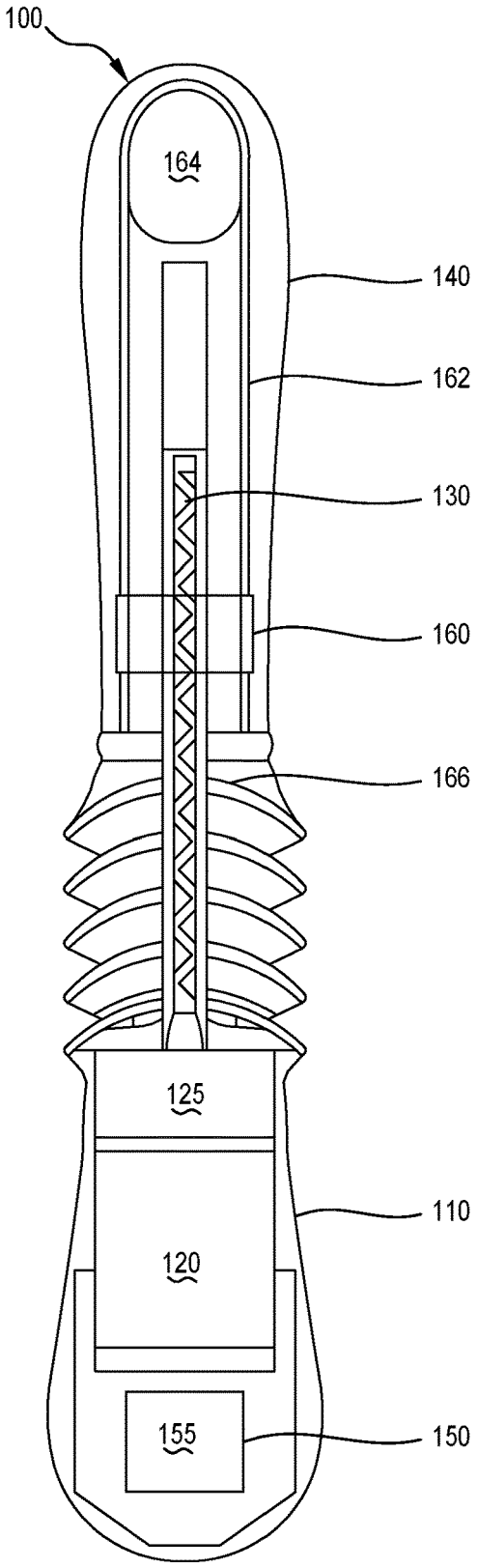
FIG. 1 is a sectional side view of a sex toy according to a preferred embodiment of the present invention.

Skilled addressees will appreciate that elements in the drawings are illustrated for simplicity and clarity and have not necessarily been drawn to scale. For example, the relative dimensions of some elements in the drawings may be distorted to help improve understanding of embodiments of the present invention.

DETAILED DESCRIPTION OF THE INVENTION

Embodiments of the present invention relate to sex toys, adult toys or internal massagers, such as thrusting vibrators, and in particular motorised sex toys, adult toys or internal massagers that perform a reciprocating motion.

FIG. 1 shows a sex toy 100 according to a preferred embodiment of the present invention. The sex toy 100 comprises a body 110 housing a motor 120. A shaft 130 is coupled to the motor 120, and a massaging member 140 is mounted over the shaft 130. A controller 150 is coupled to control the motor 120 to drive the massaging member 140 in a reciprocating motion along the length of the shaft 130. The controller 150 can comprise a plurality of selectable programs to control the extension and/or a vibration of the sex toy 100. The controller can be, for example, an integrated circuit, a chip, a processor, a logic circuit or another device capable of controlling the motor in a selectable manner.

In the embodiment shown, the shaft 130 is coupled to the motor 120 via a gear box 125. A power supply 155 is provided within the body. The power supply 155 is coupled to power the motor 120. The power supply 155 can be, for example, a battery. In some embodiments, the sex toy 100 uses an external power source, for example, to charge the battery or power the sex toy 100. The charging may be via a USB connection, induction or may make use of replaceable batteries.

In the embodiment shown, the massaging member 140 is mounted to a traveller 160 that is in engagement with the shaft 130. The traveller 160 can be, for example, annular or saddle shaped. The traveller 160 is designed to interchangeably mount massaging members 140 having different sizes and/or shapes and/or surface textures. The traveller 160 comprises a head 162 that extends over a distal end of the shaft. The head 162 includes a vibrator 164 adjacent a distal end of the massaging member 140. Vibrator 164 is shown to be housed partly within head 162 and to extend partly outside of head 162. The head 162 receives the massaging member 140 as a sleeve. Bellows 166 couple the massaging member 140 to the body 110. The bellows 166 expand when the massaging member 140 is extended.

The extension of the massaging member is of significant advantage over other isometric devices which do not provide a stroke or stroke type action. By providing a sex toy 100 that increases in length a more realistic sensation is provided.

Figure 2:
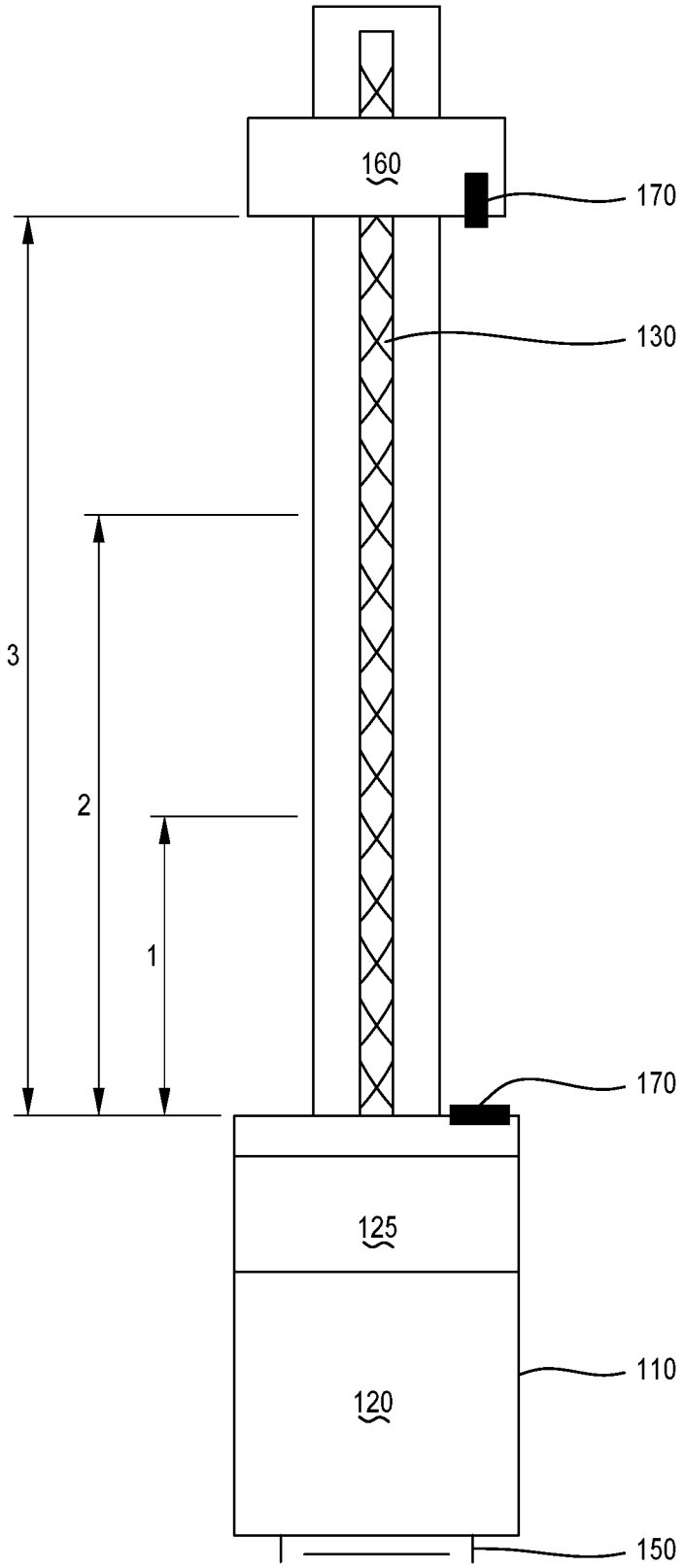
FIG. 2 is a schematic diagram showing examples of extension positions of the sex toy of FIG. 1.

The extension of the massaging member may be to a plurality of predetermined extension positions. FIG. 2 is a schematic diagram showing an example of extension positions of the sex toy 100 of FIG. 1. Four predetermined extension positions are shown, being an origin 0, a first extension position 1, a second extension position 2 and a third extension position 3. The traveller 160 is shown at the third extension position 3. The movement of traveller 160 from the origin 0 to the third extension position 3 amounts to one stroke.

The sex toy 100 may comprise one or more sensors 170 coupled to the controller 150 to determine the extension position along the shaft 130. As shown in FIG. 2, one or more sensors 170 can be provided on the body 110 and/or on the traveller 160.

In one embodiment, the controller 150 reverses the direction of the motor 120 at one or more of the plurality of predetermined extension positions to drive the massaging member 140 in the reciprocating motion.

Figure 3:
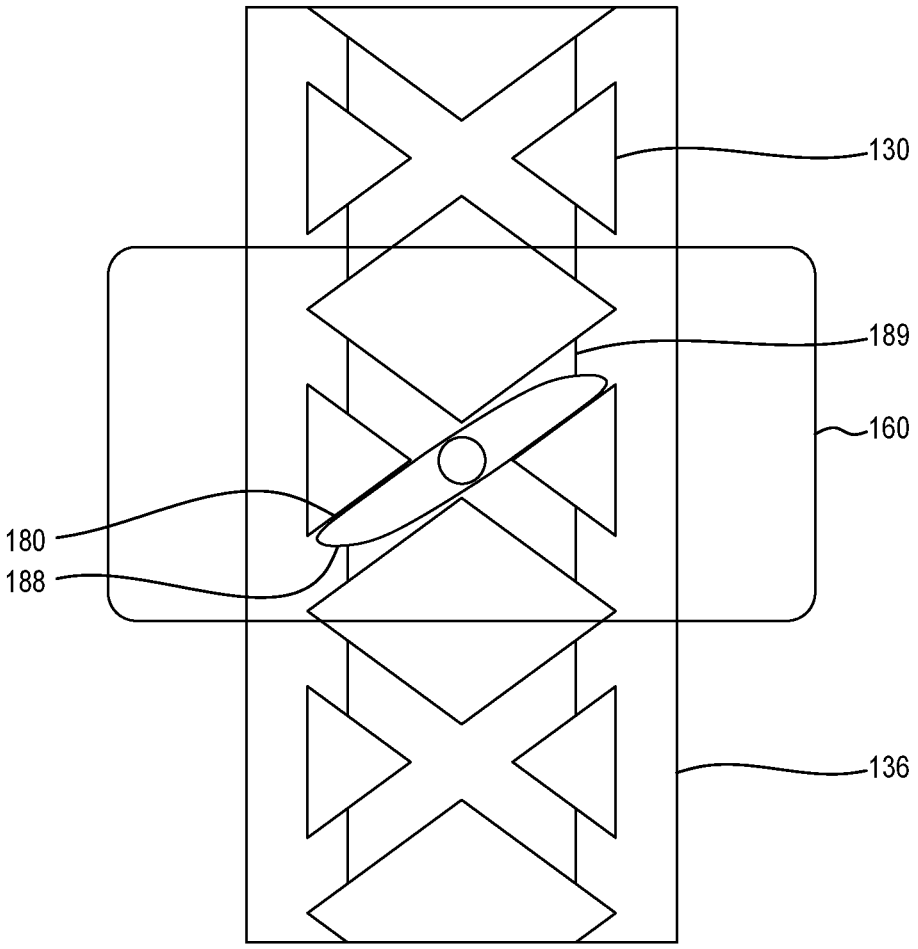
FIG. 3 is a sectional side view of a traveller engaged with a groove of a shaft of the sex toy of FIG. 1.
Figure 4:
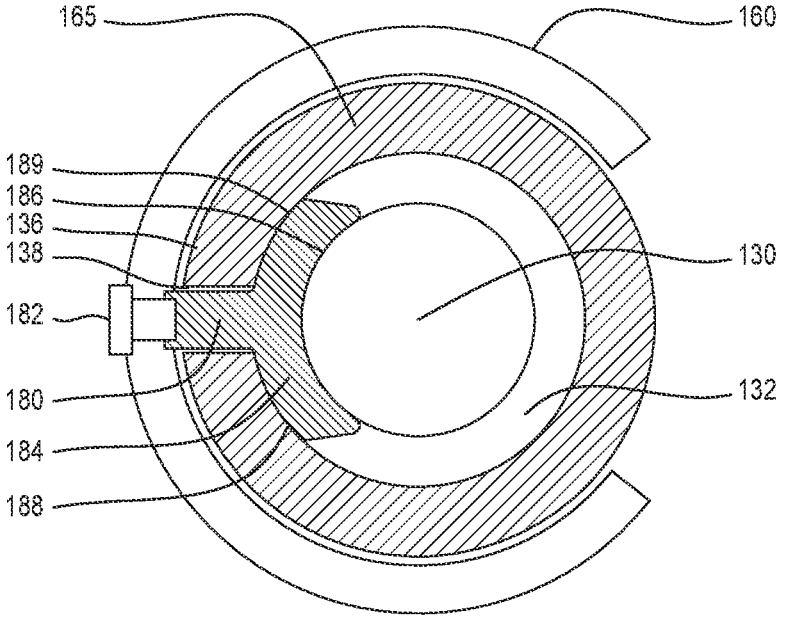
FIG. 4 is a sectional plan view of the shaft and traveller of FIG. 3.

FIGS. 3 and 4 show the engagement of the traveller 160 with the shaft 130. The traveller 160 is in engagement with the shaft 130 via a shoe 180 that is slidably mounted in a groove 132 of the shaft 130. In the embodiment shown, the groove 132 is a continuous groove formed of a left-hand helical groove and a right-hand helical groove connected to one another at either end. However, in other embodiments the groove can be a single helical groove or another appropriate groove configuration. Preferably, a pitch of the groove 132, and/or a configuration of the gear box 125, achieves a maximum torque at the traveller 160 for the motor 120.

The shoe 180 is coupled to the traveller 160 via a pin or screw 182. A guide 136 is provided between the shaft 130 and the traveller 160. The guide 136 comprises a slot 138 within head 162, the slot 138 extending along the shaft 130 to maintain an angular position of the shoe 180 relative to the shaft 130 while permitting movement of the shoe 180 along the shaft 130. When the motor 120 turns the shaft 130, the shoe 180 is held at a fixed angular position by guide 136, and the helical groove 132 of the shaft 130 slides over the shoe 180 moving the shoe 180, and hence the traveller 160 up or down the shaft 130, and consequently moving head 162 to lengthen or shorten toy 100, according to the direction of rotation of the shaft 130.

The shoe 180 comprises a shoe head 184 slidably mounted in the groove 132. The shoe head 184 has a length that is greater than a width of the groove 132, which maintains an orientation of the shoe head 184 relative to the groove 132 and prevents the shoe head 184 from switching between the left-hand helical groove and the right-hand helical groove where the grooves intersect along the shaft 130. The shoe 180 has an arcuate edge 186 facing and contacting the shaft 130. The arcuate edge 186 complements the cross sectional shape of the shaft 130. The shoe head 184 also comprises forward arcuate outer edge 188 and reverse arcuate outer edge 189 to conform to the outer edge of the groove 132.

One or more corners and/or sides of the shoe 180 are rounded and/or tapered adjacent the sides of the groove 132 to reduce sticking or jamming of the shoe 180, particularly under load. The rounded and/or tapered shape of the corner and/or side is accentuated on a leading corner or side by provision of arcuate outer edge 188 on the shoe 180 to further reduce the friction or drag. For example, the leading corner and/or side 188 can be rounded and/or tapered in such a way that the friction or drag from the sides of the groove 132 can be minimized, in particular, at the top and bottom of the groove 132 where higher friction may occur as the gradient of the groove 132 changes and the shoe 180 transitions between the left-hand helical groove and the right-hand helical groove. An opposing corner and/or side can be rounded and/or tapered in a similar way by provision of arcuate outer edge 189 to minimize friction when the shaft 130 is rotated in the opposite direction by the motor 120, for example, when the sex toy 100 is driven in shorter thrusts to the first extension position 1 or the second extension position 2.

Figure 4A:
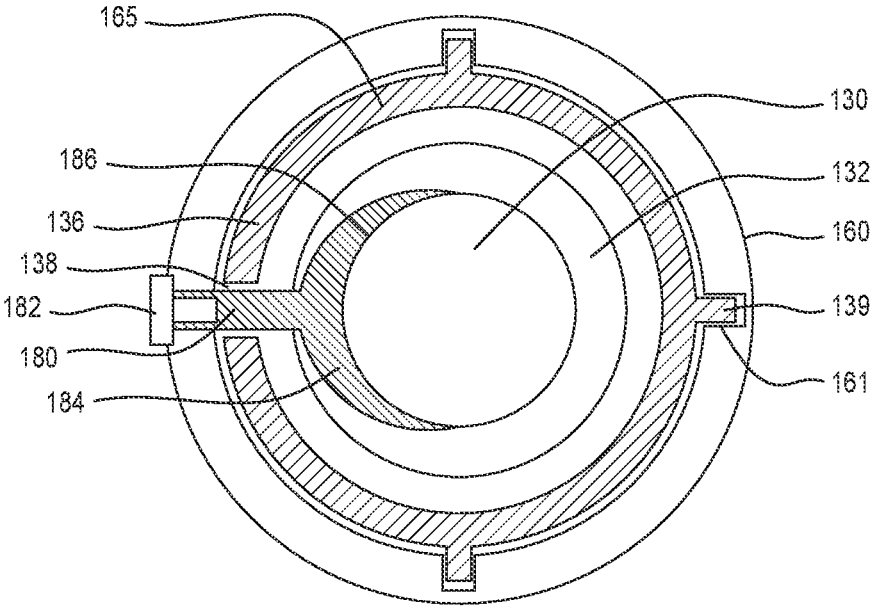
FIG. 4A is a section plan view of the shaft and traveller according to another embodiment of the invention.

FIG. 4A shows another embodiment of traveller 160 in which shoe head 184 comprises a length approximately equal to one half the circumference of the shaft. By extending the length of shoe head 184, the inventor has found that improved stability of motion is achieved.

Figure 5:
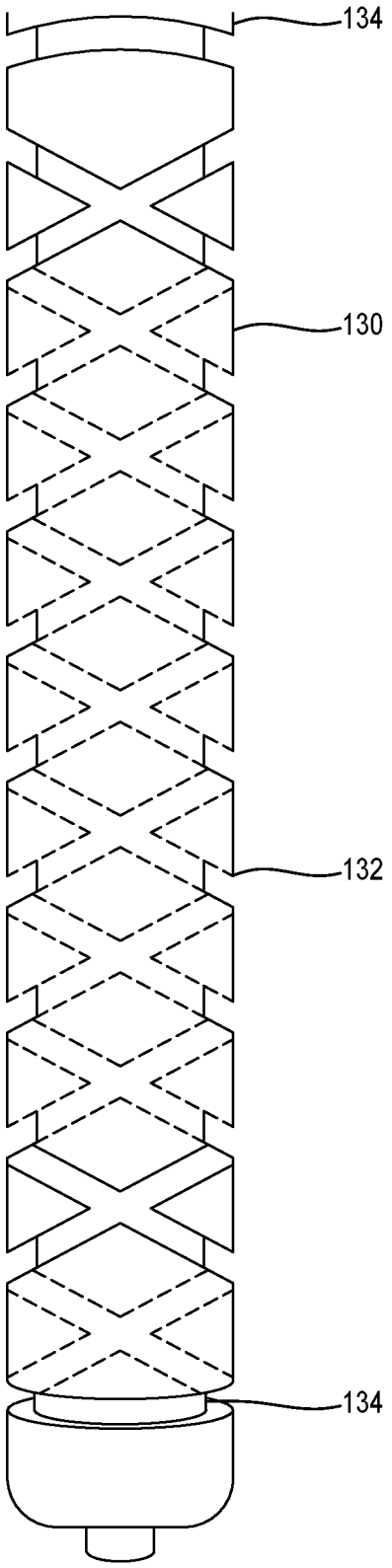
FIG. 5 is a side view of the shaft and the groove of the sex toy of FIG. 1.

FIG. 5 shows the shaft 130 and the groove 132 according to one embodiment. The groove 132 is a continuous groove formed of a left-hand helical groove and a right-hand helical groove connected to one another at either end. The continuous groove enables the shaft 130 to be rotated in a single direction and the shoe 180 to transition between the right-hand helical groove and left-hand helical groove to change a direction of movement of the traveller 160 along the shaft 130, for example, at the point where the massaging member 140 reaches a maximum or minimum extension. The curvature of the curved section 134 at one or both ends of the groove 132 is selected to provide a smooth change of direction for the traveller 160. The curvature of the curved section 134 can also be selected to increase or decrease the acceleration in the change of direction.

Figure 6:
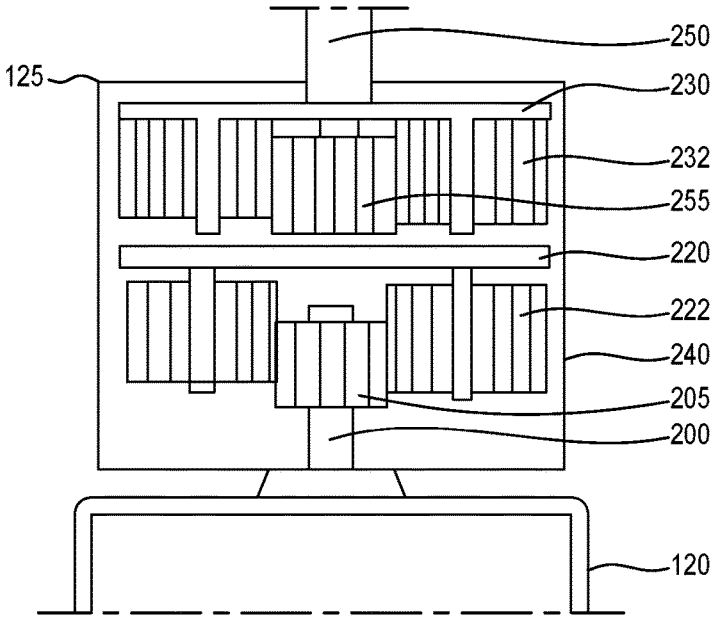
FIG. 6 is a sectional side view of a gear box of the sex toy of FIG. 1.
Figure 6A:
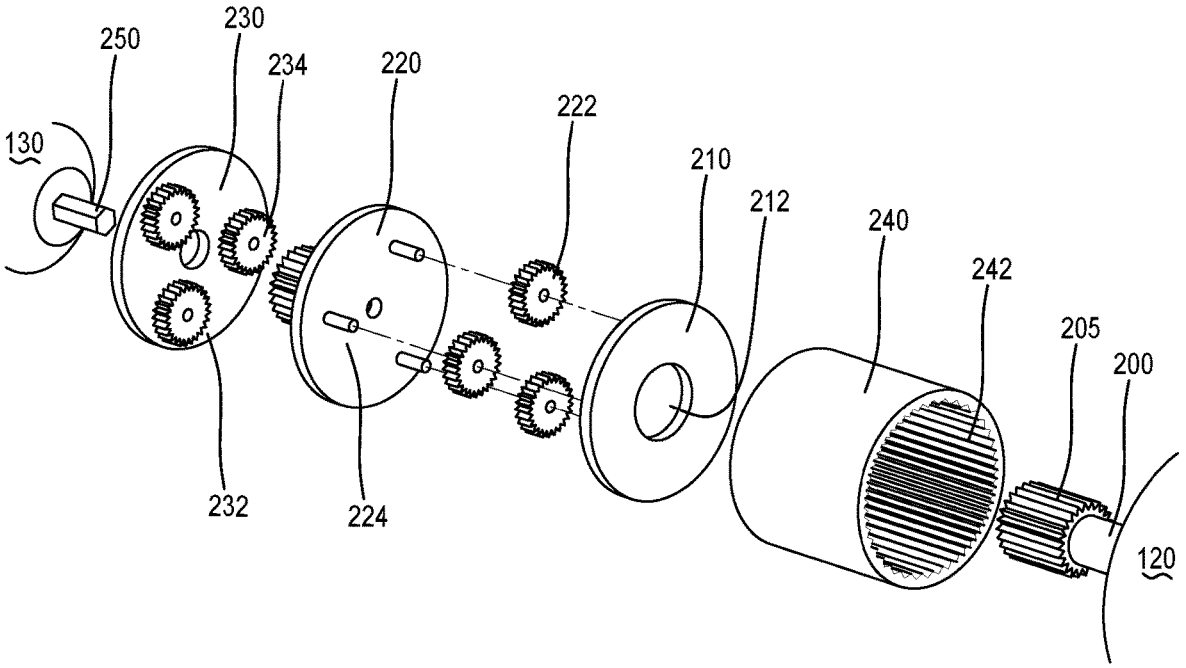
FIG. 6A is an exploded perspective view of the gear box shown in FIG. 6.

FIGS. 6 and 6A show the gear box 125 according to one embodiment. The gear box 125 comprises a first fillet ring 210, a second fillet ring 220, a third fillet ring 230 and a cylindrical casing 240. The second fillet ring 220 supports three planetary gears 222 of a first epicyclic gear train. The third fillet ring 230 supports three planetary gears 232 of a second epicyclic gear train. The cylindrical casing 240 comprises an internal gear 242 in engagement with the planetary gears 222, 232 to connect the epicyclic gear trains. The gears are supported on the fillet rings 220, 230 via spindle tines 224, 234.

The first fillet ring 210 forms an end of the cylindrical casing 240 adjacent the motor 120. A drive shaft 200 of the motor 120 is received through an aperture 212 in the first fillet ring 210 and a sun gear 205 of the first epicyclic gear train is coupled to the drive shaft 200.

The third fillet ring 230 forms an end of the cylindrical casing 240 adjacent the shaft 130. A pin 250 of the shaft is received through an aperture 232 in the third fillet ring 230 and a sun gear 255 of the second epicyclic gear train is coupled to the pin 250.

A gear ratio of the gears in the gear box 125 is configured such that the torque is increased from the motor 120 at the shaft 130.

Figure 7:
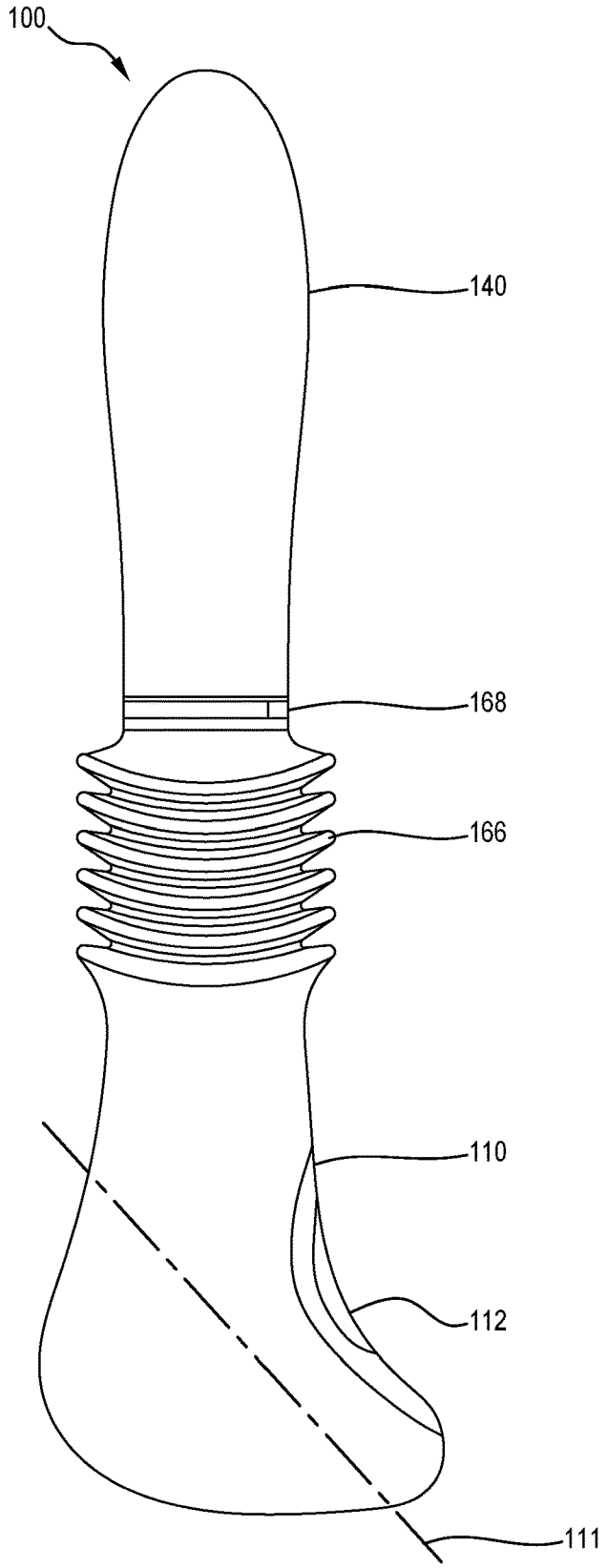
FIG. 7 is a perspective view of a sex toy according to an embodiment of the present invention showing a longitudinal axis of the body.

FIG. 7 shows a sex toy 100 according to another embodiment. In this embodiment, the body 110 is coupled to or forms part of an ergonomic handle. One ergonomic advantage is provided by the body 110 having a longitudinal axis 111 that is not aligned with the direction of extension of the massaging member 140. The longitudinal axis 111 of the body 110, for example, provides a more comfortable angle of grip for the user. The sex toy 100 is controlled by one or more user controls 112, for example buttons, on the sex toy 100. The longitudinal axis 111 of the body 110 is at an angle to the direction of extension such that the controls are visible to the user during use. For example, as shown in FIG. 7, the controls 112 are located on a face of the body 110 that substantially faces the direction of extension and therefore can be clearly viewed by the user. The controls can be used to select a program from the plurality of selectable programs, for example, to control an extension and/or a vibration of the sex toy 100.

The controls allow the speed of the reciprocating motion to be set. In one embodiment the speed may be set to one of three speeds.

Of significant advantage is the provision of a twist and click ring 168 on the massaging member 140 or the head 162 for securing the massaging member 140 or the head 162 to the traveller 160. In other embodiments, the massaging member 140 may attach to the traveller 160 via a screw thread or other known attachment means. This ready detachability simplifies cleaning and means different massaging members 140 may be attached. These different massaging members 140 may comprise different shapes; different functionalities such as, different lengths of extension and/or different vibration capabilities.

Figure 8:
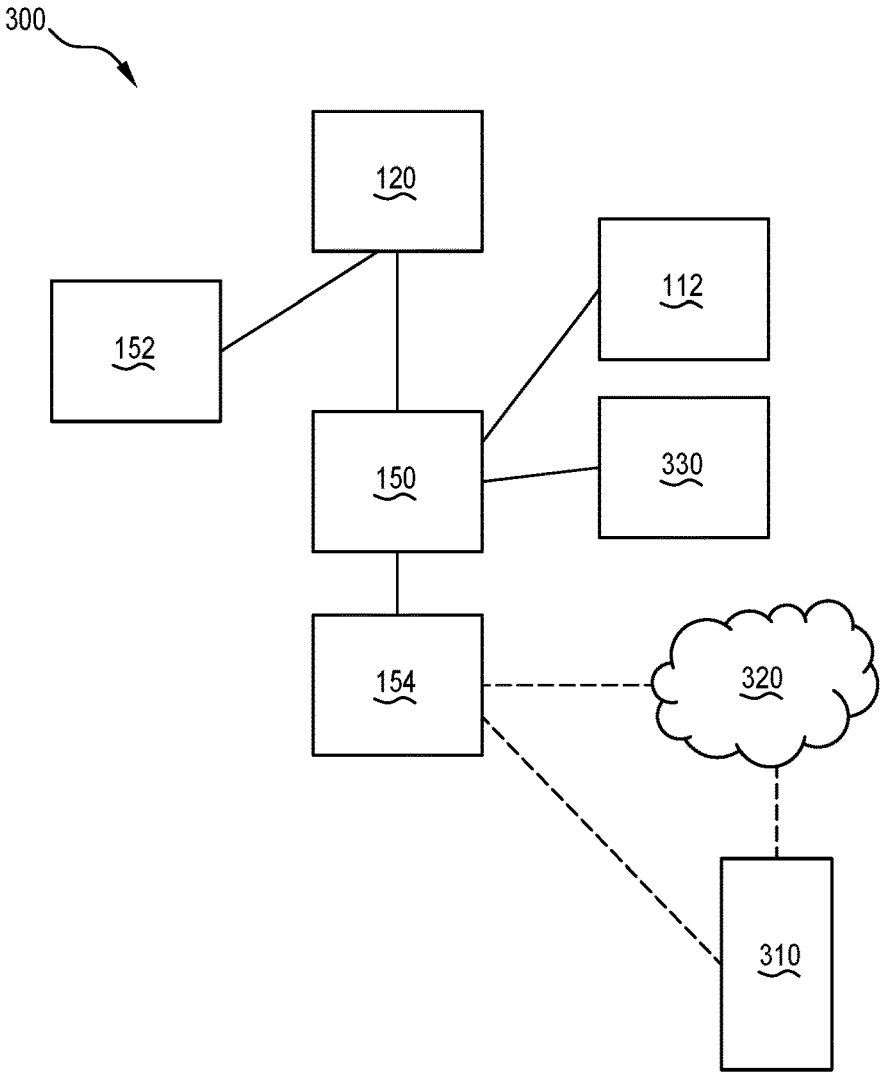
FIG. 8 is a schematic diagram of a system for controlling the sex toy according to an embodiment of the present invention.

FIG. 8 shows a system 300 according to one aspect of the invention. The system 300 comprises the controller 150 coupled to control the motor 120 to drive the massaging member 140 in a reciprocating motion to a plurality of predetermined extension positions along the length of the shaft 130. The power supply 155 is coupled to power the controller 150 and the motor. One or more user controls 112 are coupled to control the controller 150, for example, to select the plurality of selectable programs. One or more indicators 330, such as light emitting diodes (LEDs), can be coupled to the controller 150 and, for example, provided on the body 110 to indicate the current program or setting of the device. The controller 150 is also coupled to a communications device 154 to enable wireless control of the sex toy 100. For example, the communications device 154 can be a Wi-Fi and/or a Bluetooth transceiver. Wireless control can be provided via a computing device 310, for example, a smart phone, a notebook or a desktop computer. The wireless control may be provided directly or over a communications network 320, such as, the internet.

Figure 8A:
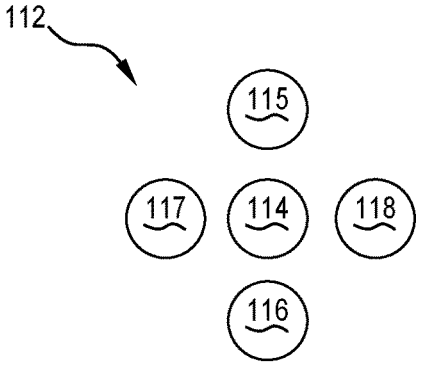
FIG. 8A is a schematic diagram of user controls for controlling the sex toy according to an embodiment of the present invention.

FIG. 8A shows the user controls 112 according to one embodiment. The user controls 112 include a power button 114 to power on/off the sex toy 100, and a decrease button 117 and an increase button 118 to decrease or increase respectively the level of vibrations or speed/extension of the traveller 160. The user controls 112 also include a vibration select button 115 to set the decrease and increase buttons 117, 118 to control vibrations, and a motor select button 116 to set the decrease and increase buttons 117, 118 to control the speed/extension of the traveller 160.

Figure 8B:
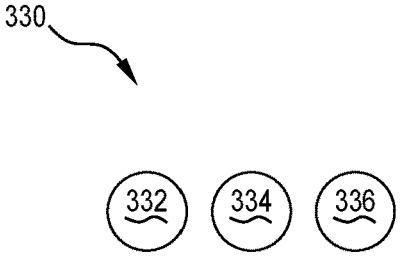
FIG. 8B is a schematic diagram of indicators for the sex toy according to an embodiment of the present invention.

FIG. 8B shows the indicators 330 according to one embodiment. A power indicator 332 is provided to show when the sex toy 100 is turned on, a vibration indicator 334 is provided to show when vibrations are active, and a moving motor indicator 336 is provided to show the motor 120 is active.

Figure 9:
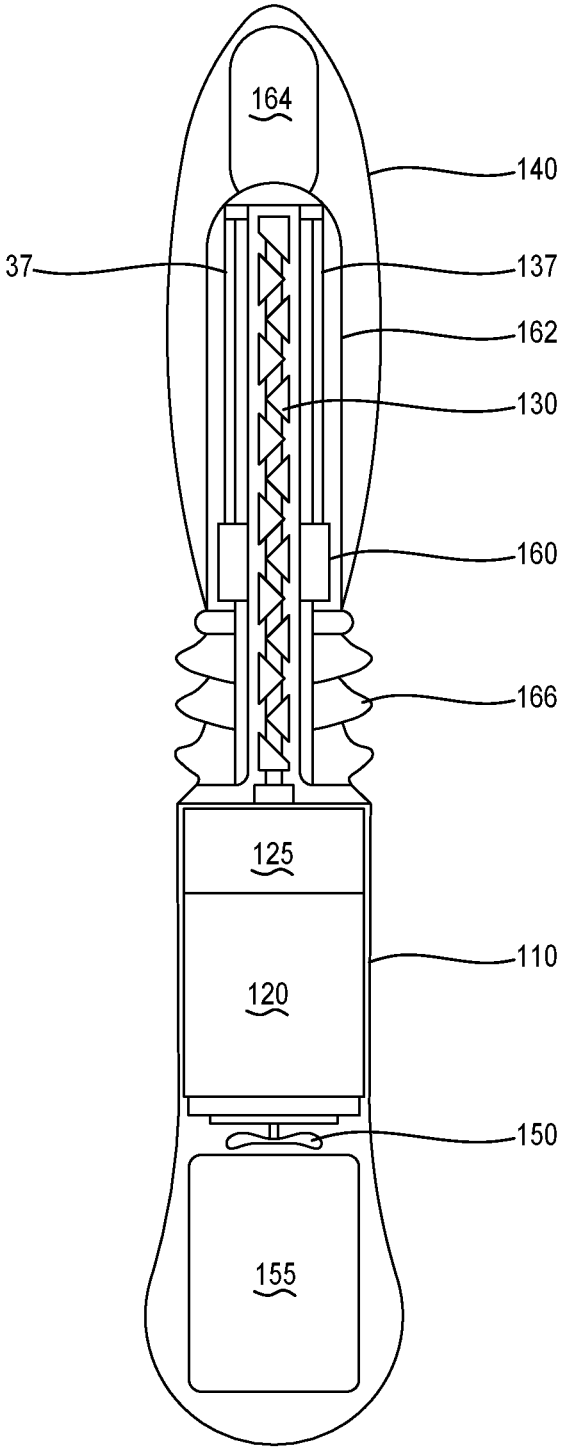
FIG. 9 is a sectional side view of another sex toy according to an embodiment of the present invention.

FIG. 9 shows another embodiment of the sex toy 100 including one or more support rods 137 along which the traveller 160 travels. The one or more support rods 137 extend along the length of the shaft 130, through the traveller 160 and provide additional sturdiness to the traveller 160, particularly under load.

In FIG. 9 the vibrator 164 is shown attached to the top or distal end of head 162.

Figure 10:
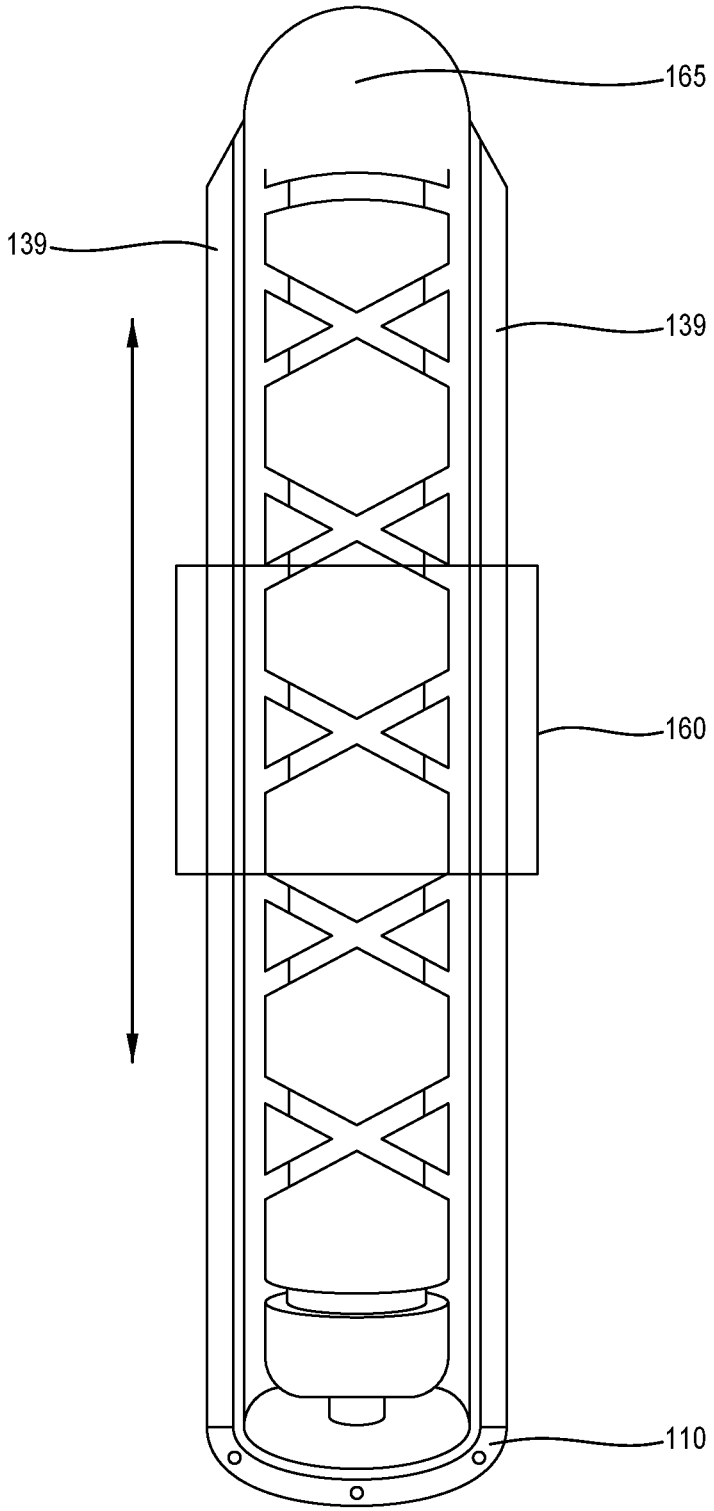
FIG. 10 is a section side view of a shaft according to another embodiment of the invention.

FIG. 10 shows another embodiment which provides additional sturdiness for sex toy 100. In the embodiment of FIG. 10 a torque sleeve 165 covers shaft 130 and one or more fins 139 are comprised on torque sleeve 165. The one or more fins 139 provide additional structural support and thereby rigidity to torque sleeve 165 and thereby toy 100, such that, any unintended movement of toy 100 is substantially reduced or eliminated. In the embodiment shown, the one or more fins 139 are integrally formed on the outside of torque sleeve 165. Torque sleeve 165 covers shaft 130 and when in position within sex toy 100 is enveloped by head 162.

Although not shown plastic sheath 167 may be positioned intermediate the torque sleeve 165 and the head 162 to provide an additional covering layer designed to improve water resistance.

Each of the one or more fins 139 engage with a complementary cavity 161 (see FIG. 4A) on traveller 160.

While FIGS. 9 and 10 show embodiments wherein the one or more support rods 137 and fins 139 extend along the full length of the shaft 130, in other embodiments one or more of the one or more support rods 137 or one or more fins 139 extends along only a part of the length of shaft 130.

The additional sturdiness provided by support rods 137 may be required in embodiments featuring a larger head 162.

From the teachings herein a skilled person is readily able to select an appropriate number of support rods 137 or fins 139. By way of example, toy 100 may comprise 1, 2, 3, 4, 5 or 6 support rods 137 or fins 139. Suitably, toy 100 comprises three support rods 137 or fins 139.

Figure 11:
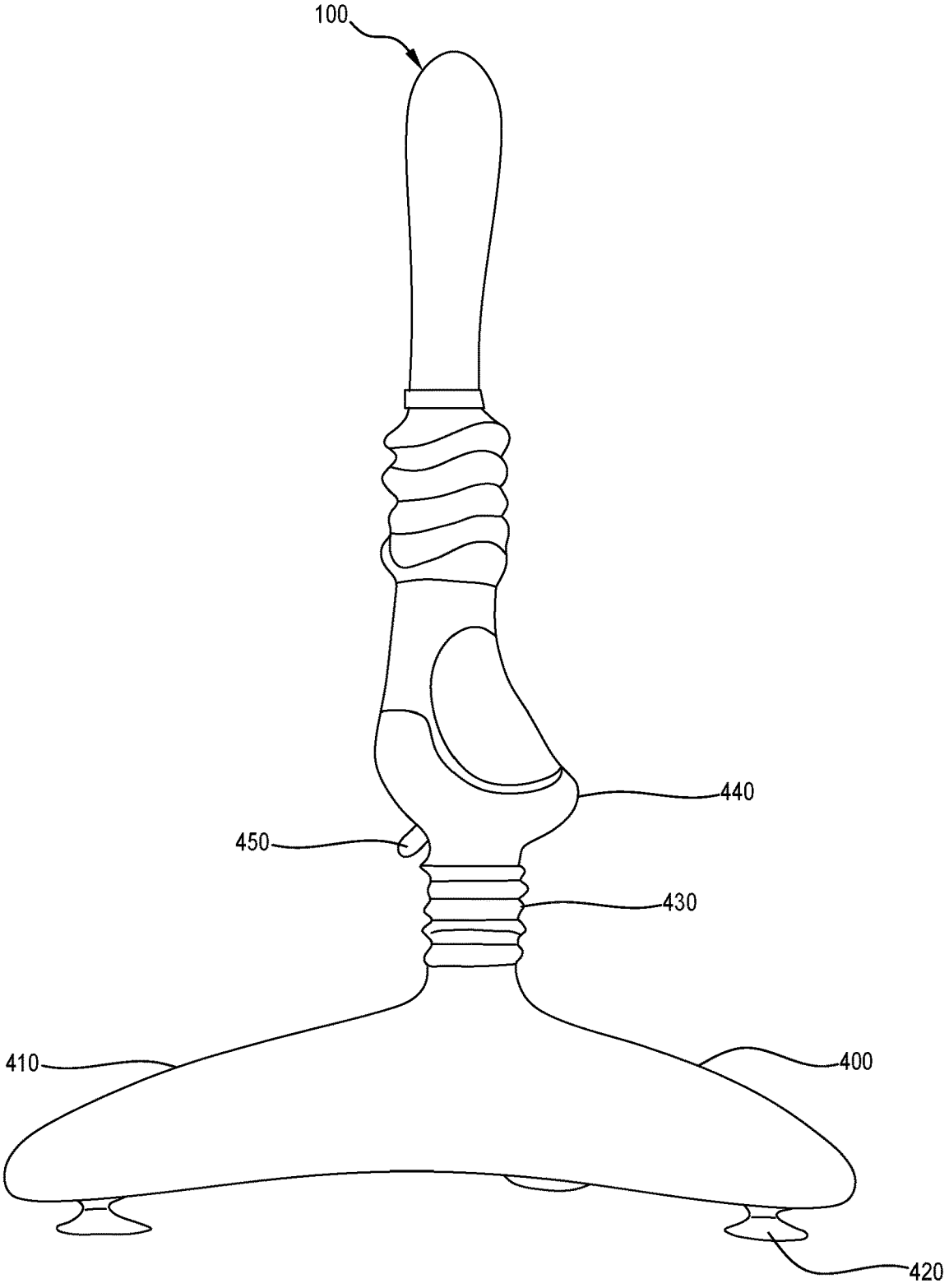
FIG. 11 is a side perspective view of a sex toy with a stand according to an embodiment of the present invention.

In some embodiments, the sex toy 100 is adapted to be coupled to a stand 400, as shown in FIG. 11. In the embodiment shown in FIG. 11, the stand 400 comprises a base 410 which can be affixed to a surface via suction caps 420. A flexible post 430 extends from the base 410. The flexible post 430 is adapted to receive the body 110 of the sex toy 100 at an opposing end of the body 110 to the massaging member 140. In the embodiment shown, the stand 400 comprises a cup 440 at an end of the flexible post 430 to receive the body 110 of the sex toy 100. The cup 440 is shaped to complement a shape of the body 110. A screw 450 is provided to secure the cup 440 to a screw hole in the body 110. The base 410, the post 430 and/or the cup 440 are shown to be formed integrally. However, in other embodiments, the base 410, the post 430 and/or the cup 440 can be separate components that are fixed together.

Figure 12:
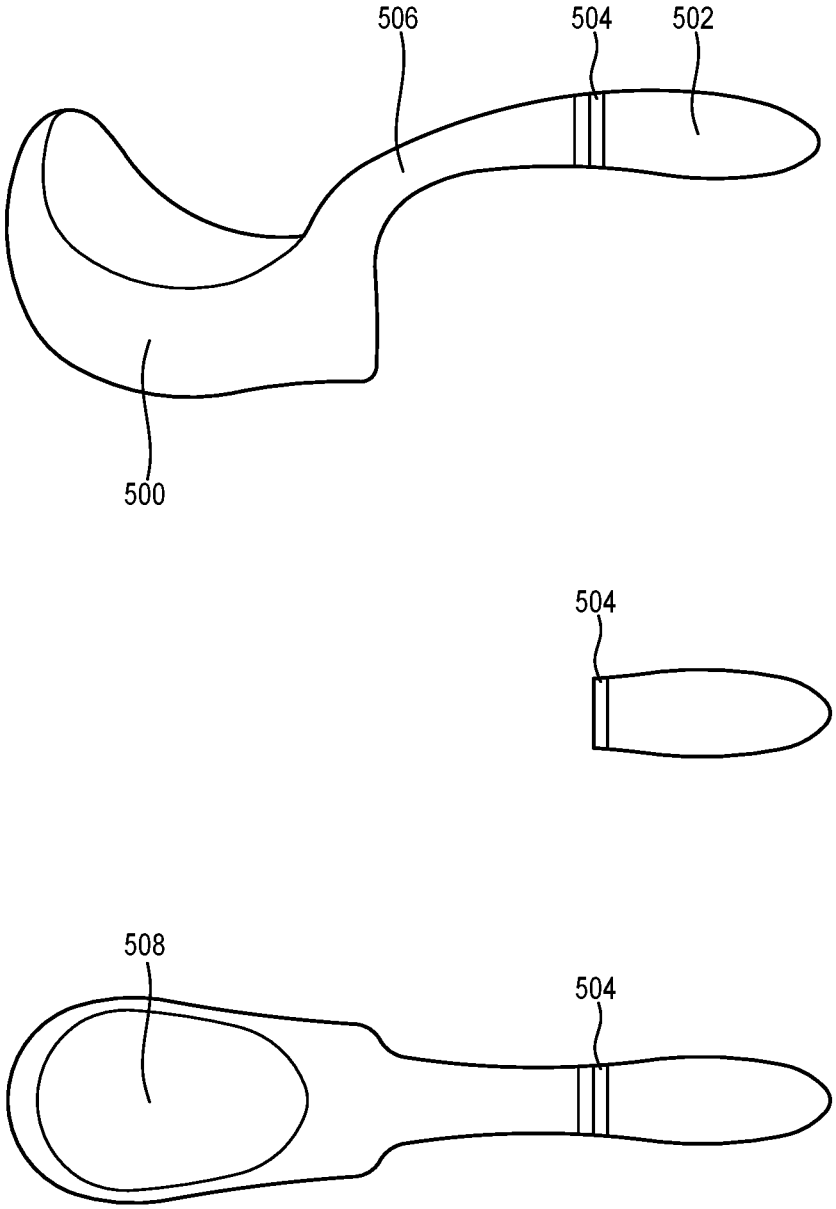
FIG. 12 shows various views of a vibration unit that may be attached to the sex toy of the invention.

FIG. 12 shows a female vibration unit 500 that may be attached to or moulded into body 110. The female vibration unit 500 may be attached to or moulded at a position to provide clitoral stimulation. As shown in FIG. 12, vibration unit 500 comprises an extension portion 506 and a control panel 508. The extension portion 506 is sized and angled to position the vibrational heads 502 for clitoral stimulation. The control panel may comprise one or more buttons to control the type of vibration. As shown in FIG. 12, the vibrational heads 502 may be interchangeable and may attach and detach with ring seals 504.

Hence, embodiments of the present invention provide a sex toy 100, adult toy or internal massager where a massaging member 140 extends in a reciprocating motion to provide a more realistic thrusting sensation to the user. A controller 150 is provided to drive the massaging member 140 between a plurality of predetermined extension positions, for example, according to a selected program or at the choice of a user. This provides more interest, variety and hence better stimulation to a user than the vibrators or dildos having a single repetitive thrusting distance in the prior art. A compact motor 120 and gear box 125 is provided such that the body 110 comprising the motor 120, power supply 155 and gear box 125 occupies a smaller portion of the sex toy 100. The body 110 can also act as an ergonomic handle to provide better control for the user. The gear box 125 also provides a sturdy connection between the motor 120 and the shaft 130 and provides increased torque to the shaft 130 to prevent the traveller 160 from sticking under load. Further, the shoe 180 is designed to reduce jamming or sticking of the traveller 160 under load.

In this specification, adjectives such as first and second, and the like may be used solely to distinguish one element or action from another element or action without necessarily requiring or implying any actual such relationship or order. Where the context permits, reference to an integer or a component or step (or the like) is not to be interpreted as being limited to only one of that integer, component, or step, but rather could be one or more of that integer, component, or step etc.

In this specification, the terms "comprises", "comprising" or similar terms are intended to mean a non-exclusive inclusion, such that an apparatus that comprises a list of elements does not include those elements solely, but may well include other elements not listed.

Throughout the specification the aim has been to describe the invention without limiting the invention to any one embodiment or specific collection of features. Persons skilled in the relevant art may realize variations from the specific embodiments that will nonetheless fall within the scope of the invention.

What is claimed is:

1. A sex toy comprising:

a body housing a motor;

a shaft coupled to the motor, the shaft comprising a helical groove;

a massaging member mounted over the shaft, the massaging member mounted to a traveler, the traveler comprising a head that extends over a distal end of the shaft, the traveler in engagement with the shaft via a shoe;

the head enveloping a torque sleeve covering the shaft and one or more fins integrally formed on the outside of the torque sleeve, so that when the torque sleeve is in position covering the shaft the one or more fins extend along at least a part of a length of the shaft to provide additional structural support and rigidity to reduce or eliminate any unintended movement of the toy;

the torque sleeve comprising a guide provided between the shaft and the traveler, the guide comprising a slot within the head, the slot extending along the shaft to maintain an angular position of the shoe relative to the shaft while permitting linear movement of the shoe along the shaft; and a controller coupled to control the motor to drive the massaging member in a reciprocating motion along the length of the shaft;

wherein the traveler is in engagement with the shaft and each of the one or more fins engaging with a complementary cavity on the traveler, and the shoe comprises a shoe head that is slidably mounted in the helical groove so that when the motor rotates the shaft the traveler is driven along the shaft and the one or more fins to drive the massaging member in a reciprocating motion along the length of the shaft that results in a change of length of the sex toy.

2. The sex toy of claim 1, wherein the change in length comprises 20 mms to 100 mms; 25 mm to 90 mm; or 30 mm to 85 mm.

3. The sex toy of claim 1, further comprising one or more user controls to select a program from a plurality of selectable programs, wherein the plurality of selectable programs control an extension and/or vibration of the sex toy.

4. The sex toy of claim 1, wherein the change in length of the sex toy is from an origin to a first extension position, a second extension position or a third extension position.

5. The sex toy according to claim 1, further comprising one or more sensors coupled to the controller to determine an extension position of the massaging member along the shaft.

6. The sex toy of claim 1, comprising a twist and click ring for securing the massaging member to the traveler.

7. The sex toy of claim 1, wherein the groove is a continuous groove formed of a left-hand helical groove and a right-hand helical groove connected to one another at either end.

8. The sex toy of claim 1, wherein the shoe head comprises a length approximately equal to one half the circumference of the shaft.

9. The sex toy of claim 1, further comprising one or more support rods extending along at least a part of a length of the shaft.

10. The sex toy of claim 1, further comprising a vibrator located at a distal end of the massaging member.

11. The sex toy claim 1, further comprising a female vibration unit attached to or moulded into the body.

* * * * *